US005487487A

United States Patent [19]

Hammett

[11] Patent Number: 5,487,487

[45] Date of Patent: Jan. 30, 1996

[54] CRENELATED CONTAINER CASE

[75] Inventor: Roy Hammett, Odessa, Fla.

[73] Assignee: International Container Systems, Inc., Tampa, Fla.

[21] Appl. No.: 283,204

[22] Filed: Jul. 28, 1994

Related U.S. Application Data

[63] Continuation-in-part of Ser. No. 241,614, May 11, 1994, Pat. No. 5,421,471.

[51] Int. Cl.[6] ..... B65D 1/24

[52] U.S. Cl. ..... 220/509; 206/503; 206/507; 206/509

[58] Field of Search ..... 206/503, 507, 206/509; 220/509

[56] References Cited

U.S. PATENT DOCUMENTS 4,410,099 10/1983 deLarosiere .
4,700,836 10/1987 Hammett .
4,700,837 10/1987 Hammett .
4,899,874 2/1990 Apps et al. .
5,060,819 10/1991 Apps .

*Primary Examiner*—Joseph M. Moy
*Attorney, Agent, or Firm*—Robert D. Schaffer; Rogers and Wells

[57] ABSTRACT

A bottle carrier case having a crenelated side wall, for transporting bottles of beverage. The case has locating means on the bottom of the case for stably stacking the case and has openings provided in the concavities for easily removing the case from overlying bottles. The bottle carrier case is able to both directly stack and cross-stack up to about 50% of its overall depth.

11 Claims, 7 Drawing Sheets

CRENELATED CONTAINER CASE

This is a continuation-in-part application of U.S. patent application Ser. No. 08/241,614, filed on May 11, 1994, now U.S. Pat. No. 5,421,471.

BACKGROUND OF THE INVENTION

1. Field of the Invention

The present invention generally relates to a reusable, ergonomically enhanced, plastic bottle case for transporting bottles of beverage. Specifically, the present invention discloses a bottle carrier case having clean lines with a serrated, or crenelated side profile, encompassing several different designs and dimensions, each of which are adapted for transporting different bottle sizes. Each bottle carrier design has ergonomic features which enable the user to more easily and efficiently load, stack, and unload cases full of bottles than has been heretofore realized.

2. Description of the Related Art

It has become increasingly common for beverages such as soft drinks to be sold in bottles made of plastic. Bottles made of plastic polyethylene terephthalate (PET) have become especially popular with the soft drink industry because of their transparency, light weight, and low cost. The light weight characteristic of these bottles has enabled the soft drink manufacturers to have ever increasing bottle capacities. Such capacities commonly include 16 oz., 20 oz., and 1, 2, and 3 liters, and may include other varying sizes. These, in turn, result in ever increasing case weight.

Cases of bottles of soft drinks are customarily stacked one on top of the other for warehouse storage and subsequent shipment. For example, U.S. Pat. No. 4,344,530 of de Larosiere discloses a molded plastic case which may be loaded with PET bottles and stably stacked. The case has bottle pockets which are shaped to closely fit the bases of the bottles which are inserted in the pockets. The pockets are shaped to orient the bottles along the centerlines of the pockets. Thus, bottles seated in the pockets of the case disclosed in the '530 patent may be stably stacked. A problem arises, however, when the stacked cases need to be individually manually unloaded. It is difficult to easily slide a loaded case off of the supporting bottles from an underlying case.

U.S. Pat. No. 4,700,836 of Hammett was designed, among other purposes, to address this type of unloading problem which arises, incidentally most often when a delivery person is unloading cases from a delivery truck to a retail store. Although the case disclosed in the '836 patent affords stable stacking, it is difficult to manually remove a loaded case from a stack of cases. This appears to be a problem in all known bottle carrier cases. The more stably a fully loaded bottle carrier case can be stacked, the more difficult it is for someone to remove a loaded case.

A further requirement of bottle carrier cases is to be able to cross-stack the cases both when they are fully loaded with bottles and when they are empty. This cross-stacking feature greatly increases the stability of any stack, whether it be empty of full. More particularly, it is an additional requirement that when empty cases are cross stacked or column stacked that they nest as deeply as possible into the underlying cases. This affords both increased stability and the ability to transport as many cases as possible in the same volume.

There is therefore a great need in the art for a case which can be stably stacked when fully loaded which can be stably stacked when empty and which can be easily unloaded from that stack when full.

SUMMARY OF THE INVENTION

Accordingly, there is now provided with this invention an improved bottle carrier case for effectively overcoming the aforementioned difficulties and longstanding problems inherent in removing fully loaded stacked bottle carrier cases which are stably stacked and which are able to be cross stacked both empty and fully loaded and which nest as deeply as possible in the underlying case. These problems have been solved in a simple, convenient, and highly effective way by providing the lower portion of the bottle carrier nesting portions with side openings. More particularly, side openings are provided at key locations in the nesting portions of the stably stacked carrier cases. This affords an unloading operation having unparalleled ease. Additional objects of the present invention will become apparent from the following description. This particular feature is more fully described in my copending patent application, Ser. No. 08/241,614, filed on May 11, 1994 and entitled "Ergonomic Container Case".

According to one aspect of the invention, a nestable carrier case for carrying a plurality of containers is disclosed. The nestable case comprises a base having a top surface and a bottom surface. The top surface comprises a plurality of areas corresponding to the plurality of containers. The case also has a crenelated side wall connected to the base and extending around the top surface of the base. When an identical case is nested thereon, the identical case nests into the crenelations greater than one quarter the depth of the overlying case. When an identical case is cross-stacked thereon, the identical case nests into the crenelations greater than one third the depth of the overlying case. As will be appreciated by those persons skilled in the art, a major advantage provided by the present invention is a case that is stable when stacked either in a column or cross stacked, is still easily removable from that stack, and which can be stacked when empty a great percentage of its depth. It is therefore an object of the invention to provide a carrier case which will be widely used in the industry due to its safety when stacking, and one which incorporates ergonomic design principles to afford ease of unloading a loaded stacked case.

It is another object of the invention to provide a carrier case which can be columnar nestable with identical cases to a great percentage of its depth when the cases are unloaded.

It is still another object of the invention to provide a case which is nestable to a great percentage of its depth when cross-stacked when the case is unloaded.

It is a further object of the invention to provide a case which has easy handholds for persons carrying and unloading both full and empty stacks of cases.

The present invention will be better understood by reference to the following detailed discussion of specific embodiments and the attached figures which illustrate and exemplify such embodiments.

DESCRIPTION OF THE DRAWINGS

A specific embodiment of the present invention will be described with reference to the following drawings, wherein.

DESCRIPTION OF THE PREFERRED EMBODIMENT

The following preferred embodiment as exemplified by the drawings is illustrative of the invention and is not intended to limit the invention as encompassed by the claims of this application.

Figure 1:
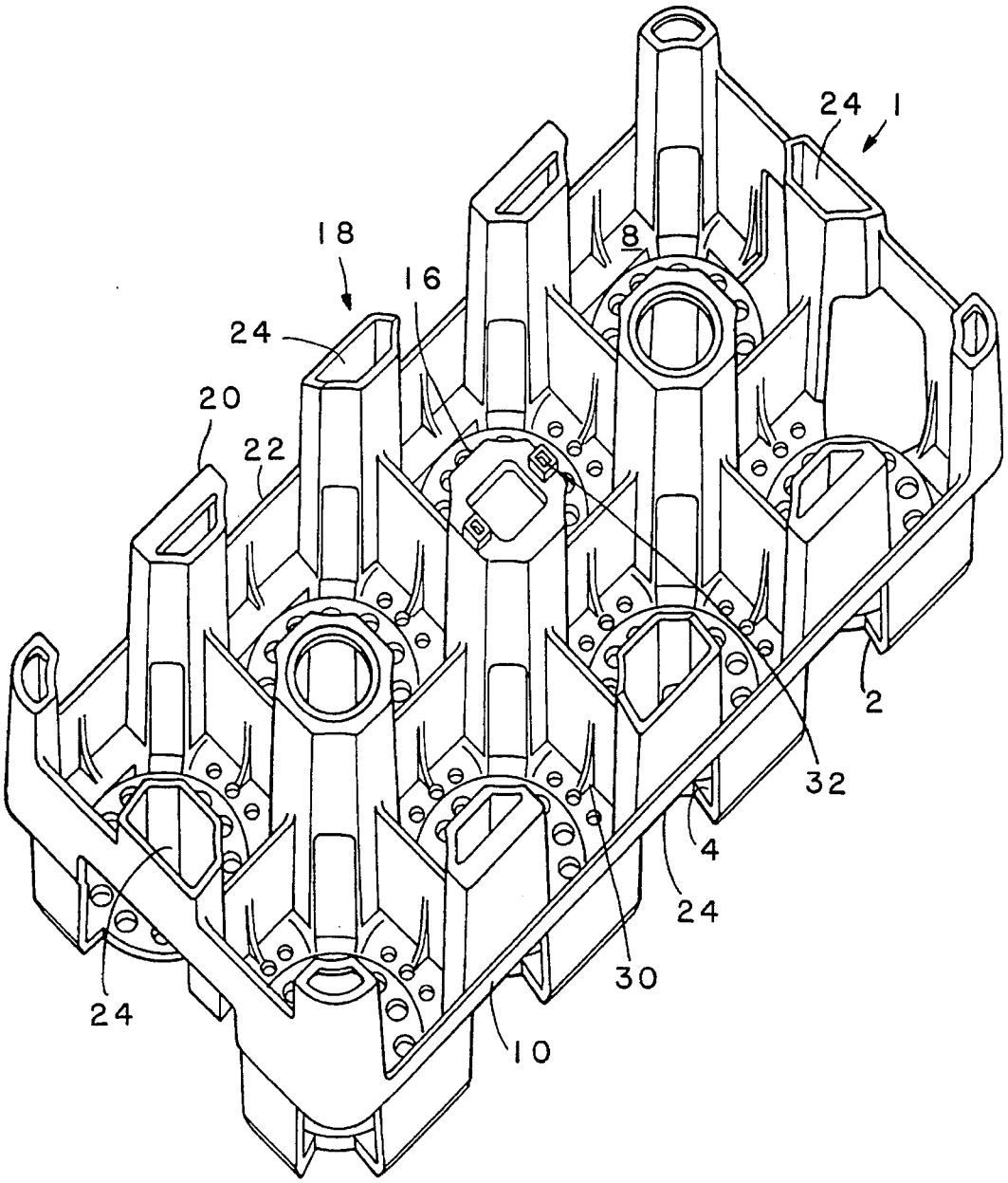
FIG. 1 is an orthogonal representation of the top of the container case of the present invention.
Figure 2:
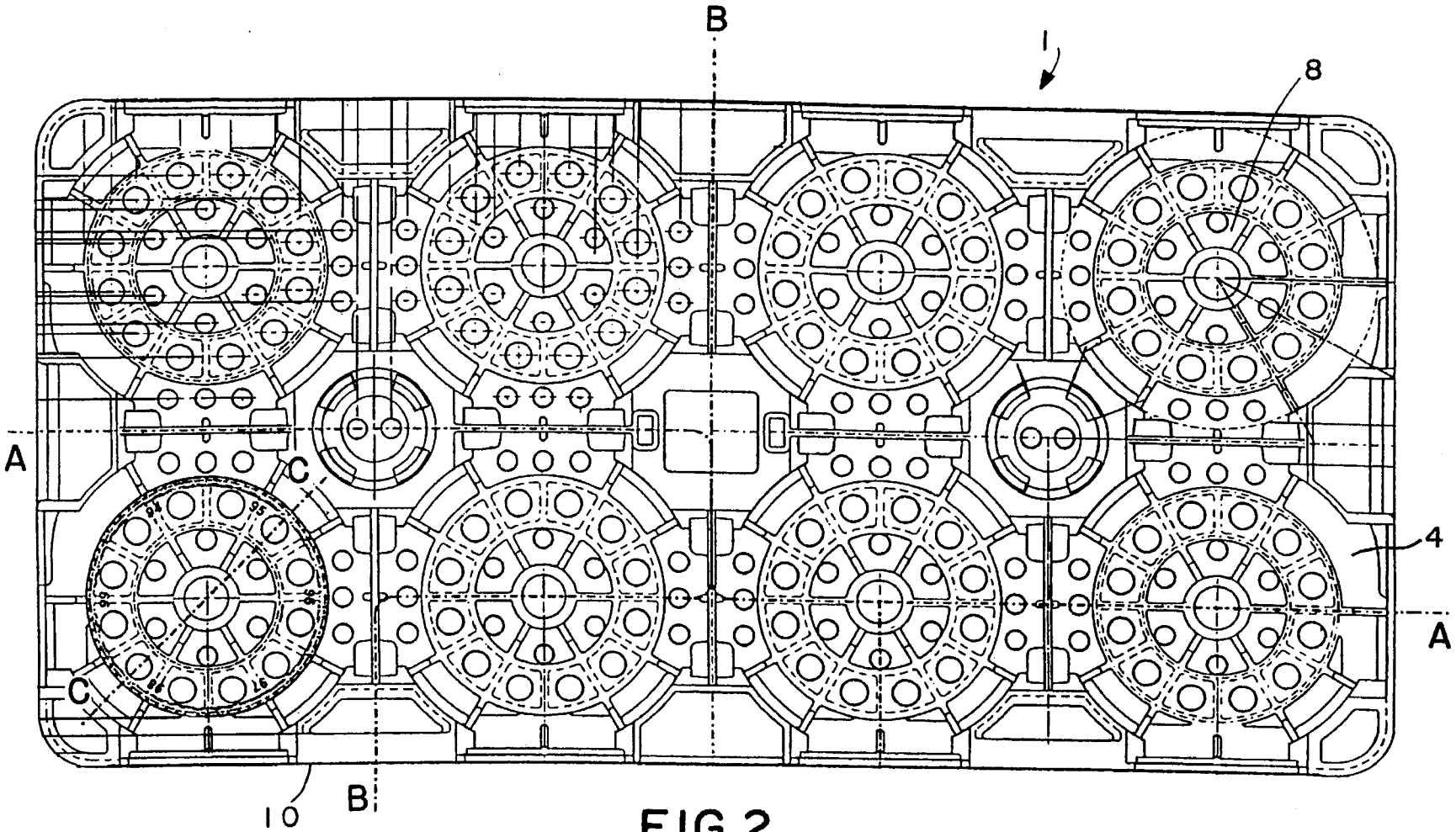
FIG. 2 is a top view of the container case of an embodiment of the present invention.

In FIG. 1, a typical container carrier case 1 is shown. As shown in FIGS. 1 and 2, the base 2 of the carrier case 1 has a top surface 4 and a bottom surface 6. The top surface 4, shown more particularly in FIG. 2, has a plurality of bottle carrying pockets 8 for defining areas in which the bottles are securely placed. The bottle-carrying pockets 8 are designed to closely match the size of the beverage-containing bottles. Closely matching the size of the pockets 8 to the bottles assures that the bottles attain a high degree of stability in the carrier case 1.

Surrounding the outer periphery of the carrier case 1 is an outer wall 10. The outer wall 10 encloses the pockets 8 on the outer periphery of the case 1 and holds the bottles therein. The outer wall 10 may be contoured on the inside to closely match the contours of the bottles in the pockets on the outer periphery of the case.

Figure 3:
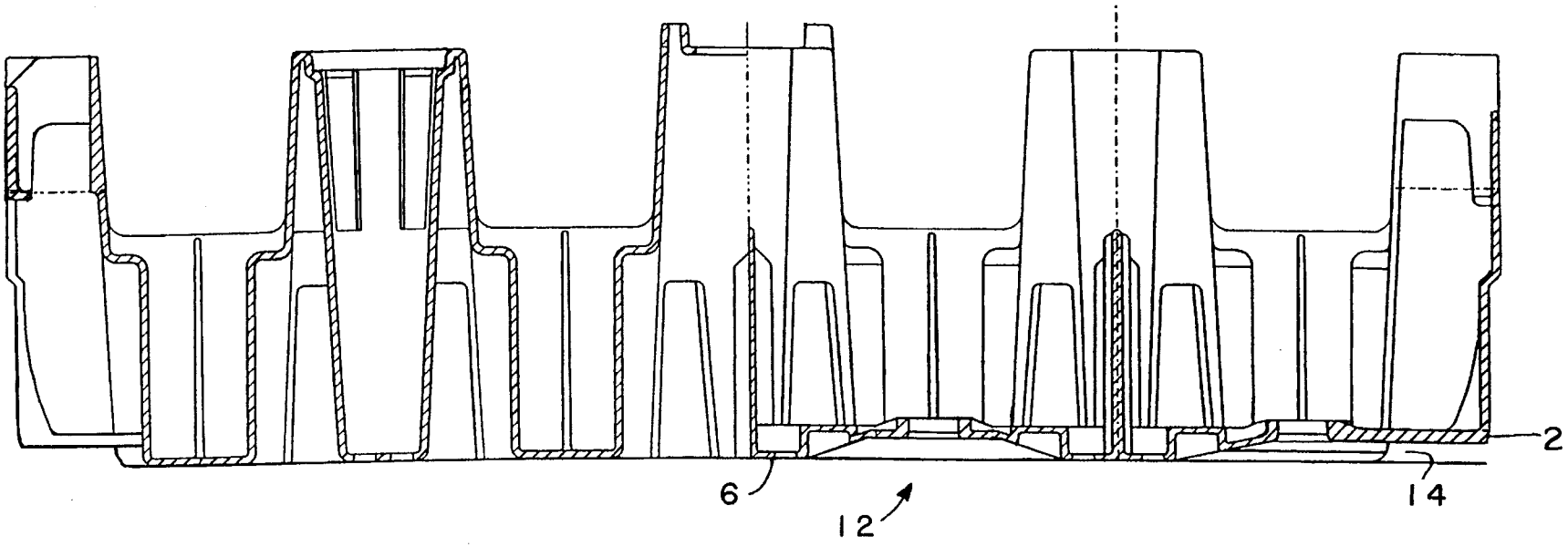
FIG. 3 is a sectional view of an embodiment of the container case of the present invention taken along lines A—A of FIG. 2.
Figure 4:
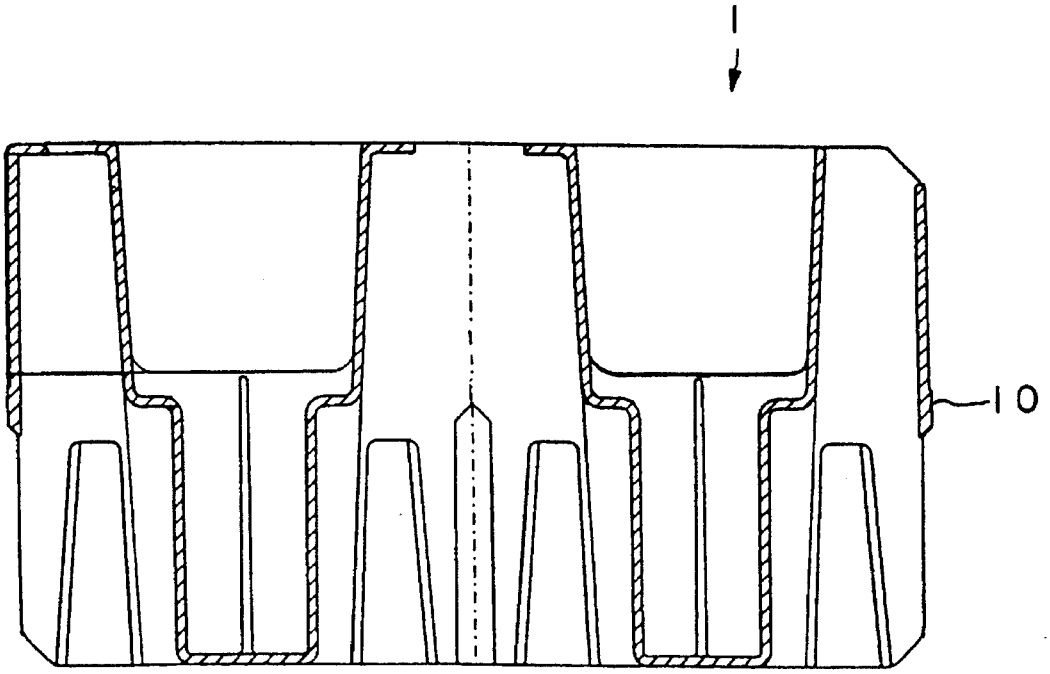
FIG. 4 is a sectional view of the container case of the present invention taken along lines B—B of FIG. 2.

As illustrated in FIG. 3, the bottom surface 6 of the case has a concave area 12 which closely matches the top of an underlying bottle. This area is directly beneath an overlying pocket 8 in order to stably stack carrying cases filled with beverage containing bottles. The concavities 12 on the bottom surface 6 of the base 2 of the cases are adapted for locating bottles from a lower case and for stacking another carrying case thereon. It has been found that when the concavities 12 entirely surround the top of an underlying bottle, it provides a stable stack of cases, but is difficult to remove an overlying case. Typically, removal of a fully loaded case is accomplished by sliding the overlying cases upon and off of the underlying bottles. However, the very feature that enables stable stacking of the containers—that is, the concavities—makes it difficult for the removal of these cases. At least one opening 14 is therefore provided in at least four of the concavities 12 of each case to ease the removal of a stackable case. It has been found that the opening 14 of a concavity should be at least as wide as the top of the underlying bottle. It is preferable for manufacturing reasons for the opening to be about as wide as the diameter of the concavity itself. This is fully described in my co-pending application Ser. No. 08/241,614 which is incorporated herein by reference.

It has also been found that it is necessary to have at least four concavities 12 on the bottom surface 6 of the base of each container for locating containers from a lower case.

Within the carrier case, pillars 16 may be placed for separating neighboring bottles. The addition of pillars 16 in the carrier case increases the degree of stability of the bottles in the carrier case. Although the pillars 16 are not necessary, they are preferable when the bottles are 1 liter, 16 oz., or 20 oz. When the bottles carded in the carrier case are 2 liter bottles, then the necessity for the pillars 16 in the container increases. Although the pillars may extend from the base of the container to above the top of the side wall, or extend from the base of the container to a height below the top of the side wall, it has been found that for optimal stability that the pillars should extend to about the same elevation as the top of the side walls.

The outer wall as disclosed herein and as generally illustrated in FIG. 1 has a crenelated side profile. The crenelations 18 comprise an upper elevation 20 and a lower elevation 22. By having such crenelations, advantages that have been heretofore unrealized can be achieved.

For example, when identical empty cases are directly stacked in alignment as in a column, one upon another, the lower case inserts into the overlying case at least up to one quarter the overall depth of an entire case. In fact, it has been found in accordance with this invention that when identical empty cases are directly stacked upon each other, in alignment, an underlying case may be inserted into an overlying case up to approximately 50% of its overall depth. This affords not only a very stable stack of empty cases, but also more empty cases can be fit into the same volume than previously achieved. This is especially beneficial when transporting empty cases.

An additional advantage is achieved by having the crenelated sidewall herein disclosed. When identical empty cases are directly cross-stacked one upon another, the lower case can insert into the overlying case at least up to one-quarter the overall depth of an entire case. In fact, it has been found in accordance with this invention, that when identical empty cases are cross stacked upon each other, an underlying case may be inserted into an overlying case up to approximately 50% of its overall depth. This affords not only a very stable stack of empty cases, but also more empty cases can be fit into the same volume than previously achieved.

In the preferred embodiment, as illustrated in FIG. 1, the crenelations 18 are recessed inwardly from the outer wall 10. Customer names, or brand names, or logos are often printed using a wide variety of technologies, upon the outer surface of the crenelations. By indenting or recessing the crenelations from the outer wall, marring or scraping of the printed matter by an overlying case is minimized.

An additional feature that is included in the present invention is the central placement of indentations for handholds 24 on each side of the case. By centrally placing the handholds 24, a loader may grasp an overlying case with one hand while steadying the stack with another. In this way, a fully loaded case may be evenly and safely pulled off of a stack without upsetting the remaining stack of cases. Preferentially, the handholds 24 are formed by having an opening formed from the top of the upper elevation, or by having an opening formed at the lower end of a crenelation, or by having a hollow formed entirely throughout a crenelation.

Figure 8:
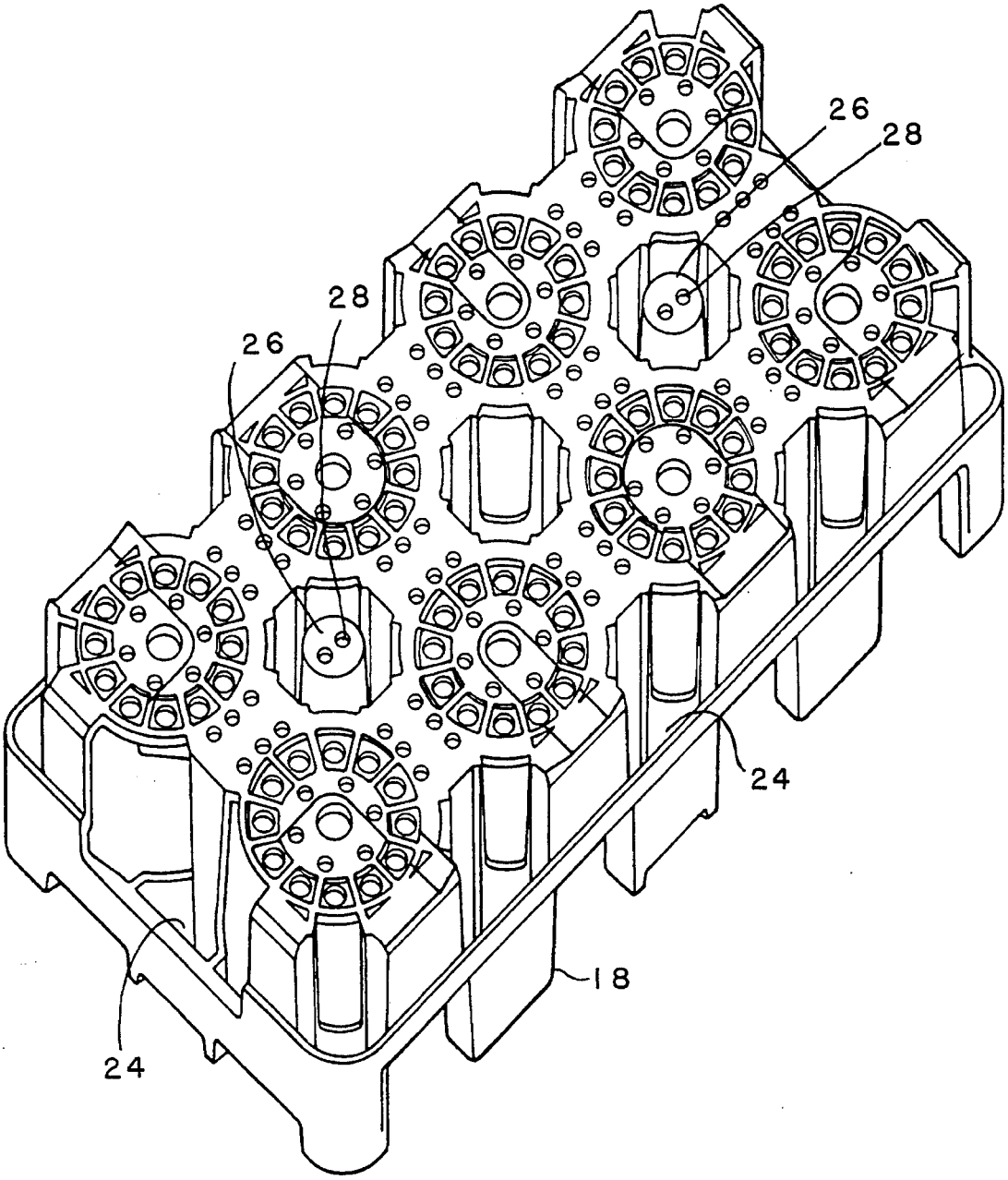
FIG. 8 is an orthogonal representation of the bottom of an embodiment of the container carrier case of the present invention.

As shown in FIG. 1, in an eight pocket case, it is preferential to have three central pillars; two outside pillars and an inner pillar. These pillars are, among other reasons, for supporting the containers in the pockets. It has been found that it is preferential to have the pillars be conically tapered. As shown most particularly in FIG. 8, the centralmost pillar should be substantially open on the bottom. This is to allow the empty cases to both directly stack and cross-stack when empty. Additionally, as illustrated in FIG. 1, the pillars should have ribs 30 extending from the pillars toward the center of the pockets. The ribs 30 are for supporting the sides of the container and for aiding to centrally locate the container in the pockets 8. Further, as illustrated in FIG. 8, the two outer pillars should have an inner tapered element 26. This feature allows for more stable stacking. When the inner tapered element is employed, at least one hole 28 should be made therein to prevent trapping of water and debris therein.

It has been further found that it is preferential to have a relatively small projection 32 on the top of one of the pillars. As shown in FIG. 1, the projection 32 is placed on top of the most central pillar. Of course, it could also be placed on top of any of the pillars. The extension 32 is for frustrating inappropriate use of the case. Oftentimes, workers will invert a container case and inappropriately use the case as a step-stool. By providing the projection 32 on a pillar, when a container case is overturned, the container case will not lie flat and this will inhibit workers from using the container cases in this inappropriate manner.

FIGS. 5, 6, 7, and 8 illustrate various views showing the concavities on the base 2 of the carrier case. As shown, the concavities provide a locating means for bottles from a lower case. The bottles from a lower case are thus located in the concavities of the upper case for stably stacking the case on the bottles.

Figure 6:
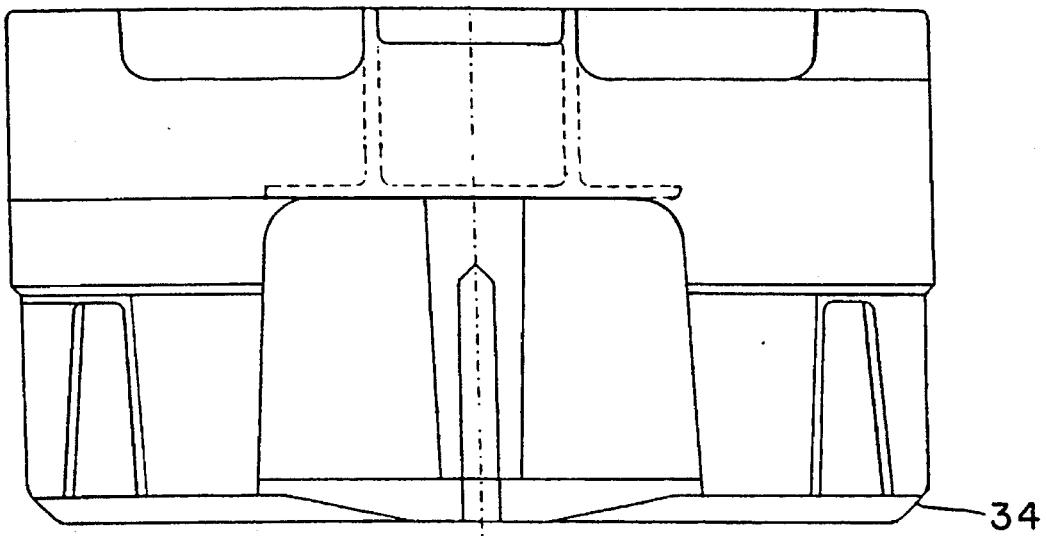
FIG. 6 is a side view of an embodiment of the container carrier case of the present invention.
Figure 5:
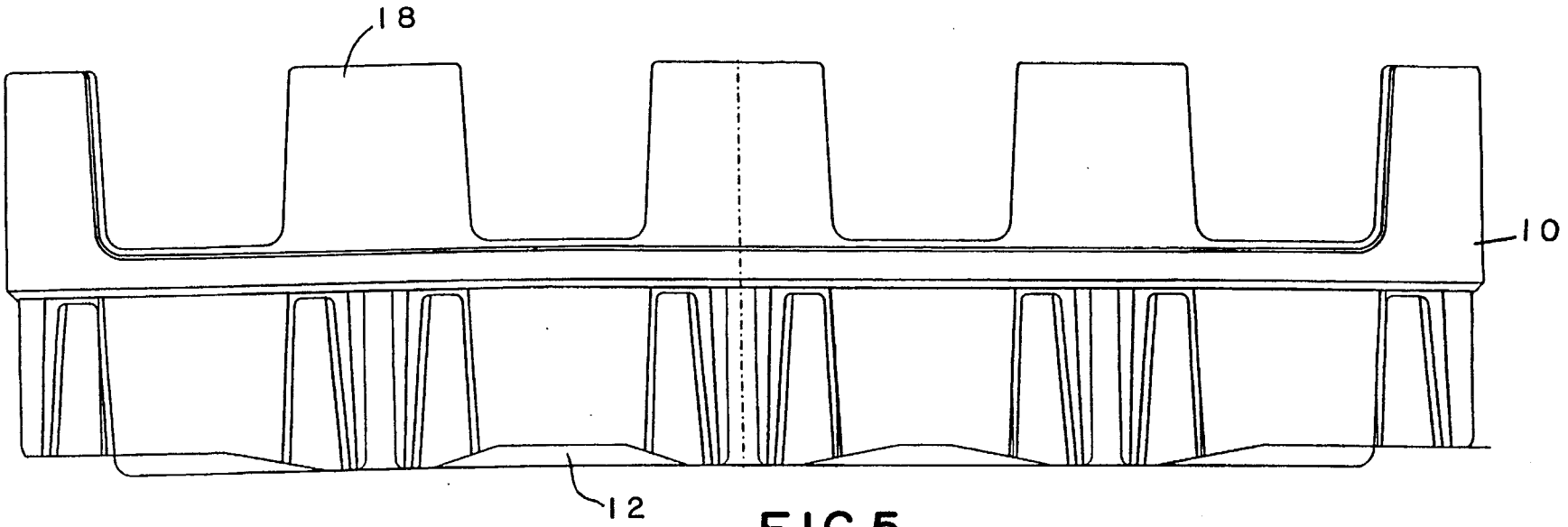
FIG. 5 is a front view of an embodiment of the container case of the present invention.
Figure 7:
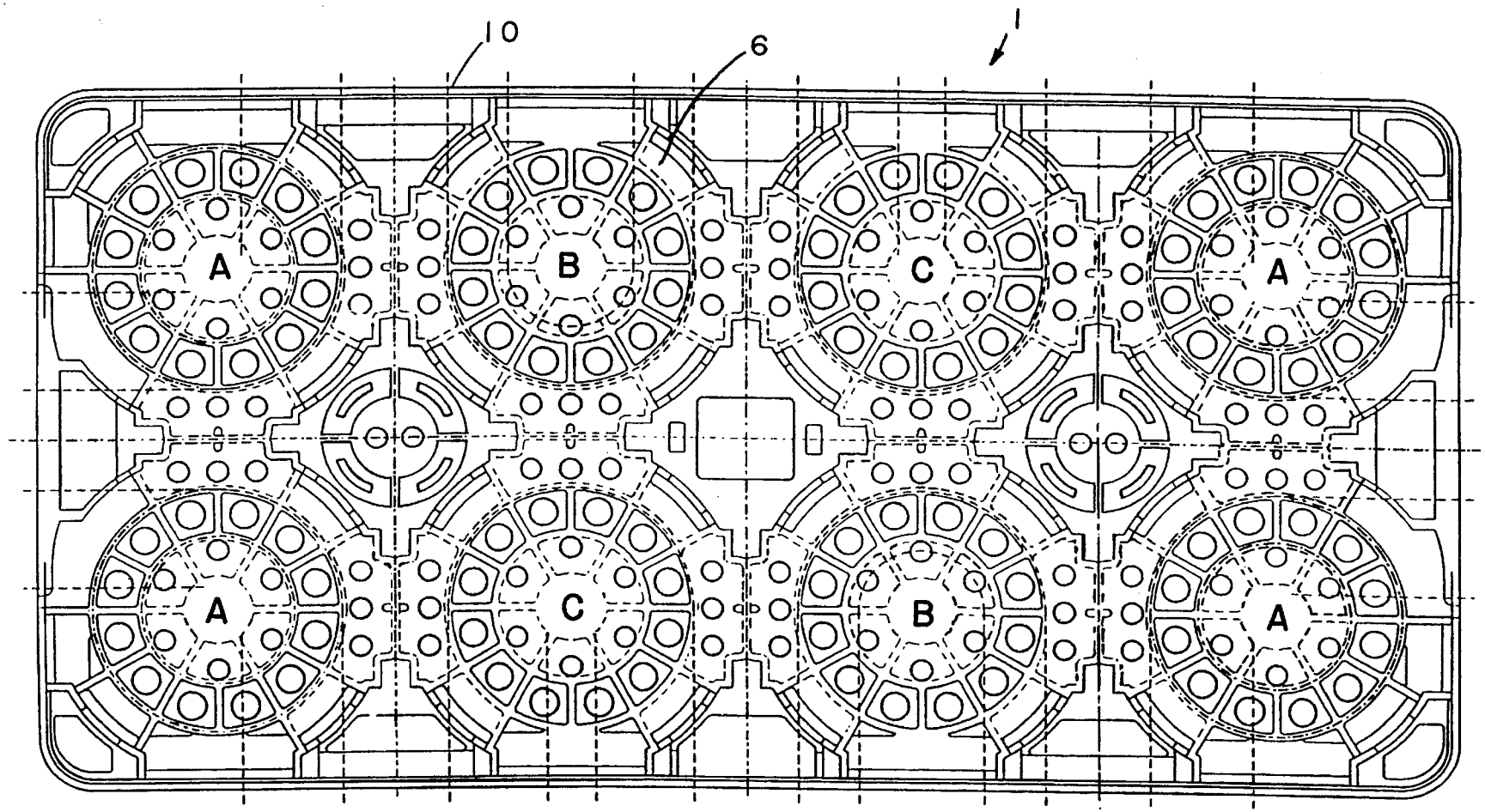
FIG. 7 is a bottom view of an embodiment of the container carrier case of the present invention.

FIG. 3 is a side view taken showing a concavity with an opening to the outer wall 10. As illustrated, this concavity has the feature of both locating a bottle from a lower case and for providing an easy path of removal of a loaded case off the supporting bottle. Also shown in FIG. 6 is an angle 34 provided on the outer periphery of the base 2. The angle should be in the range of from about 30° to about 60°, but it has been found to be preferably about 45°. Having an angle 20 around the entire periphery of the base 2 allows nestability on an underlying case when it is stacked without any beverage containing bottles. The angle 20 also provides for the interposition of a hand cart or any other lifting means when the case is placed directly upon a flat surface.

I claim:

1. A nestable case for carrying a plurality of containers, comprising:

a) a base having a top surface and a bottom surface, wherein said top surface comprises a plurality of areas corresponding to the plurality of containers; and b) a crenelated sidewall connected to said base and extending around said top surface of said base, said crenelated sidewall being dimensioned such that when an identical case is nested thereon, the sidewall of the identical case nests into the overlying case more than one-quarter the depth of the overlying case, and when the identical case is cross-stacked thereon, the identical case nests into the overlying case more that one-third the depth of the overlying case.

2. The case of claim 1, wherein when an identical case is nested wherein, the identical case nests into the overlying case about one-half the depth of the overlying case and when the identical case is cross-stacked thereon, the identical case nests into the overlying case about one-half the depth of the overlying case.

3. The case of claim 1, further comprising an indentation on each side of said sidewall, wherein said indentation is adapted for accommodating fingers of a hand for carrying the case.

4. The case of claim 1, wherein at least a portion of said crenelated sidewall is inwardly recessed.

5. The case of claim 4, further comprising pillars projecting from said top surface of said base for supporting containers placed in said plurality of areas.

6. The case of claim 5, wherein the bottom of at least one of said pillars is substantially open.

7. The case of claim 5, wherein the top of at least one of said pillars has a projection thereon so that an overturned case will not lie flat when placed upon a substantially flat surface.

8. The case of claim 5, wherein said pillars are tapered.

9. The case of claim 5, wherein said pillars further comprise ribs extending therefrom for supporting containers placed in said areas.

10. The case of claim 5, further comprising at least four concavities on said bottom surface of said base for locating containers from a lower case and for stably stacking the nestable case thereon, wherein at least four of said concavities have at least one opening therein for slidably removing the stackable case.

11. The case of claim 10, wherein said base has an outer periphery having an angle therein for interposition of a lifting device when the case is placed directly on a flat surface.

* * * * *